US005105961A

United States Patent [19]

Norén et al.

[11] Patent Number: 5,105,961

[45] Date of Patent: Apr. 21, 1992

[54] SCREW TOP CLOSURE

[75] Inventors: Mona Norén, Sollebrunnd; Rudolf Gladys, Trollhättan; Jan Berglund, Västra Frölunda, all of Sweden

[73] Assignee: AB Cerbo, Sweden

[21] Appl. No.: 592,852

[22] Filed: Oct. 4, 1990

[30] Foreign Application Priority Data

Oct. 4, 1989 [SE] Sweden ..... 8903251

[51] Int. Cl.[5] ..... B65D 53/00

[52] U.S. Cl. ..... 215/345; 215/252; 215/258; 215/354; 215/211

[58] Field of Search ..... 215/224, 252, 258, 211, 215/214, 354, 355, 356

[56] References Cited

U.S. PATENT DOCUMENTS

| | | | |
|---|---|---|---|
| 3,850,328 | 11/1974 | Guala | 215/252 |
| 4,133,462 | 1/1979 | Lindström | 215/252 X |
| 4,197,960 | 4/1980 | Walter | 215/252 X |
| 4,280,632 | 7/1981 | Yuhara | 215/331 |
| 4,330,067 | 5/1982 | Deussen | 215/252 X |
| 4,457,438 | 7/1984 | Varlet et al. | 215/252 |
| 4,629,081 | 12/1986 | McLaren | 215/224 X |
| 4,629,082 | 12/1986 | Badia Iniesta | 215/252 |
| 4,706,829 | 11/1987 | Li | 215/354 |
| 4,759,455 | 7/1988 | Wilson | 215/224 X |
| 4,776,475 | 10/1988 | La Vange | 215/224 X |

FOREIGN PATENT DOCUMENTS

| | | |
|---|---|---|
| 2148364 | 3/1973 | France . |
| 2436722 | 4/1980 | France . |
| WO84/1763 | 5/1984 | PCT Int'l Appl. . |
| 2034288 | 6/1980 | United Kingdom . |
| 2053864 | 2/1981 | United Kingdom . |

*Primary Examiner*—Stephen Marcus
*Assistant Examiner*—Paul A. Schwarz
*Attorney, Agent, or Firm*—Ostrolenk, Faber, Gerb & Soffen

[57] ABSTRACT

A screw top closure comprising a screw lid (10) with internal threading and a separate lid attachment (11) with external threading. The lid attachment (11) is designed for application on the neck (12) of a container (13) to carry the removable lid, the lid attachment (11) being in the form of an annular element with an upper part (14) serving as support for the lid (10), and two concentric tubular flanges (15, 16) protruding downwardly therefrom. These flanges between them in downward direction define an open pocket (17) for receipt of the neck (12) of the container (13). The lid (10) is provided with an inner tubular flange (25) protruding downwardly from an upper portion (21) thereof, the flange being insertable into the lid attachment (11) and designed to be brought into sealing abutment under pressure against the inner tubular flange (16) of the lid attachment (11) at a lower portion (16) thereof having reduced inner diameter in relation to the part of the flange (16) located above such that the inner flange of the lid attachment and the inner flange of the lid remain in sealing abutment with each other during partial unscrewing of the lid from the neck of the container.

5 Claims, 2 Drawing Sheets

Figure 1A:
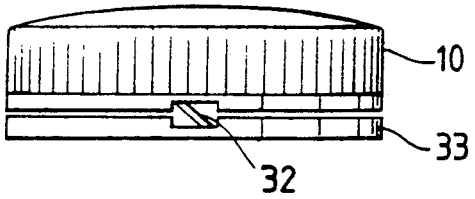

Fig. 2
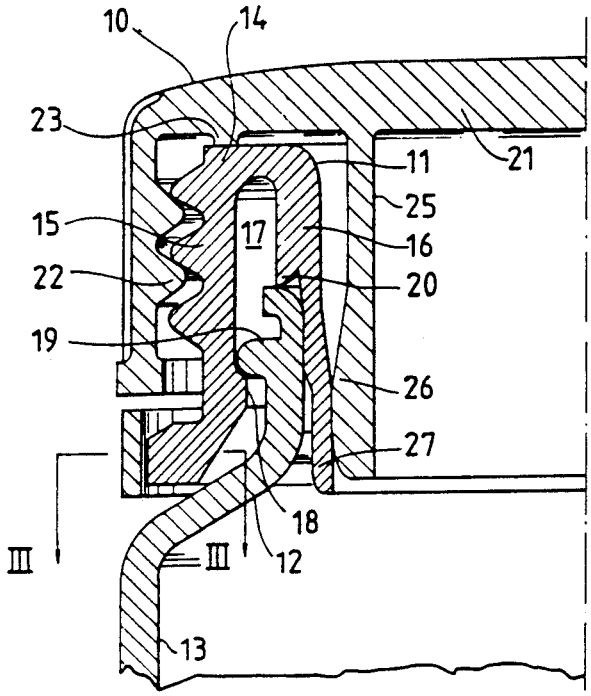
Fig. 3
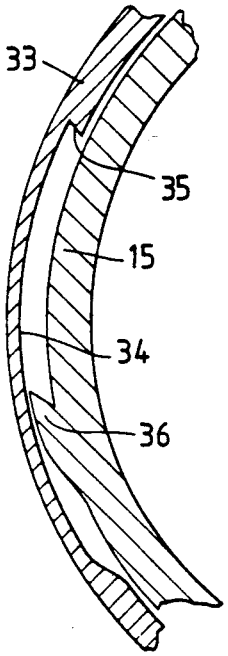
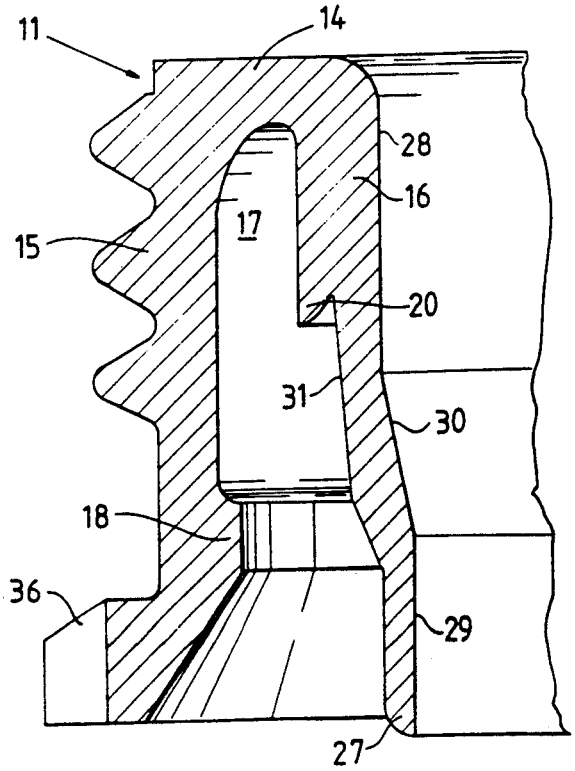
Fig. 4

SCREW TOP CLOSURE

TECHNICAL FIELD

The invention refers to a closure of the type comprising a screw lid with internal threading and a separate lid attachment with external threading, said attachment being designed for application on the neck of a container to carry the removable lid, the lid attachment being in the form of an annular element with an upper part serving as support for the lid, and two concentric tubular flanges protruding downwardly therefrom, the flanges defining between them in downward direction an open pocket for receipt of the neck of the container.

To achieve sufficient elasticity in the lid and the lid attachment, both these are made of yielding plastic material, such as polythene.

Screw top closures of this type are used inter alia for sealing jars of medicine. It is often vital that tablets or the like contained in such jars are not subjected to the action of moisture from the surrounding atmosphere. It is therefore desirable for the screw top closure to be such that it effectively prevents any penetration of moisture into the jar.

The object of the invention is to achieve a new and improved screw top closure of the type described above, which will satisfy the requirement of efficient sealing in a simple manner.

CHARACTERIZATION OF THE INVENTION

The screw top closure proposed according to the invention for this purpose is primarily characterized in that the lid is provided with an inner tubular flange protruding downwardly from an upper portion thereof, said flange being insertable into the lid attachment and designed to be brought into sealing abutment under pressure against the inner tubular flange of the lid attachment at a lower portion thereof having reduced inner diameter in relation to the part of this flange located above.

Providing the lid with a tubular flange of the type described above which can be inserted into the lid attachment, and shaping the inner flange of the lid attachment with a lower portion with reduced inner diameter to cooperate with the lid flange ensures an efficient seal between lid and lid attachment even if the normal seal between the lid and the upper portion of the lid attachment serving as a support therefore is deficient, e.g. because the lid has not been screwed on sufficiently tight. A reinforced seal is also obtained between the lid attachment and the neck of the container as a result of the inner flange of the lid attachment pressing against the inner side of the neck under increased pressure.

In a preferred embodiment of the invention a lower portion of the inner flange of the lid is provided with an external peripheral enlarged rim by means of which it can be brought into abutment with the inner flange of the lid attachment. This rim gives rise to added rigidity in the lid flange at the part intended to abut against the inner flange of the lid attachment, thus facilitating obtaining a high abutment pressure.

The inner flange of the lid attachment may preferably be provided with an inner peripheral surface having a generally conical section located between an upper section having larger diameter and a lower section having smaller diameter, the inner flange of the lid being arranged to be brought into abutment with the inner flange of the lid attachment in a region of its inner surface located close to the transition between the generally conical section and the lower section. The inner flange of the lid attachment may advantageously be provided with an outer peripheral surface having a conical section 31 along which it can be brought into abutment under pressure with the inner side of the neck of the container under influence of the inner flange of the lid.

Shaping the inner flange of the lid attachment as described enables the increased contact pressure caused by the lid flange between said flange of the lid attachment and the neck of the container to be concentrated to a limited area. This facilitates obtaining an efficient seal between the lid attachment and the container.

The screw top closure may suitably be used as an original seal for a container. To allow visual inspection to ascertain that the seal is unbroken it should be provided with suitable sealing members. According to the invention such sealing members may advantageously comprise a sealing ring joined by breakable bridges in a manner known per se to the lower part of the wall of the lid, said ring being designed to be separated from the lid when the lid is unscrewed from the lid attachment, due to the action of protrusions in the outer tubular flange of the lid attachment protruding into notches in the sealing ring.

DRAWING

Figure 1B:
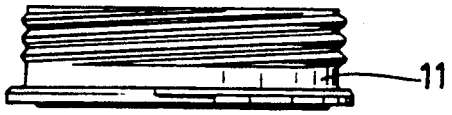
Figure 1C:
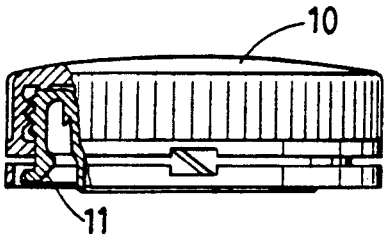
Figure 1D:
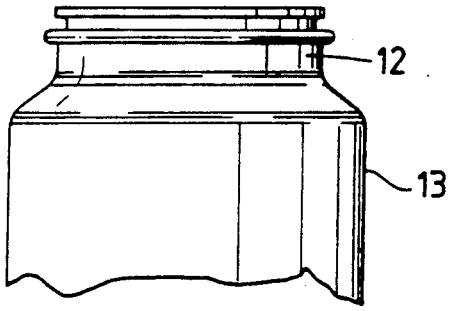
Figure 1E:
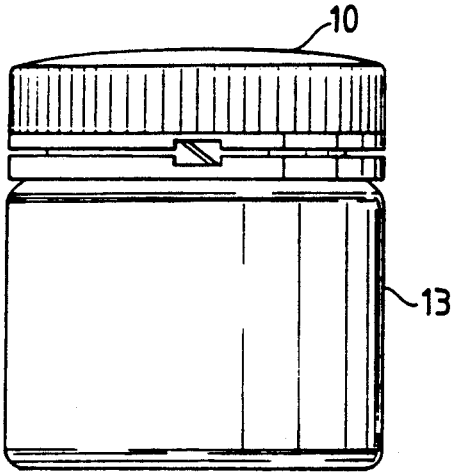

The invention will be described in more detail with reference to the accompanying schematic drawings in which FIG. 1*a* shows a front view of a screw lid for a screw top closure in accordance with one embodiment of the invention selected by way of example, FIG. 1*b* shows a front view of a lid attachment for said closure, FIG. 1*c* show a front view of the closure composed of the screw lid and lid attachment, FIG. 1*d* shows a front view of an upper part of a container with a neck intended to be sealed by the closure, FIG. 1*e* shows a front view of the container with the closure applied, FIG. 2 shows a partial vertical section of the closure and neck of the container on a larger scale, FIG. 3 shows a detailed view, in cross section, along the line III—III in FIG. 2, and FIG. 4 shows a section of the lid attachment corresponding to FIG. 2, further enlarged, prior to application of the lid on the lid attachment and prior to application thereof on the neck of the container.

EMBODIMENTS

The screw top closure shown in the drawings consists of a screw lid 10 with internal threading and a lid attachment 11 with external threading, designed to removably carry the screw lid on the neck 12 of a container 13. In the example shown the container comprises a small jar.

The lid attachment 11 is in the form of an annular element with an upper part 14 serving as support for the lid 10, and two concentric tubular flanges 15 and 16. Between them in downward direction these two flanges define an open pocket 17 in the lower part of which the neck 12 is received when the lid attachment is applied on the container 13.

To enable firm retention of the lid attachment 11 in snap engagement with the neck 12 of the container 13, said attachment is provided with an annular protrusion 18 protruding from the inner side of the outer flange 15, said protrusion being designed to cooperate with an outer peripheral rim 19 of the neck 12. The lid attachment 11 is also provided with an annular shoulder 20 on the outer side of the inner flange 16 which serves as sealing lip and stop and abuts against the upper edge of the neck 12.

The screw lid 10 is provided with an upper portion 21 in the form of a substantially flat, circular disc and a wall part 22 protruding from its peripheral edge, said wall part being provided with threading for cooperation with corresponding threading on the outer side of the outer flange 15 of the lid attachment 11. The upper part 21 of the lid is provided on its lower side with an annular protrusion 23 enabling it to abut firmly against the upper surface of the upper section 14 of the lid attachment.

25 designates a tubular flange protruding downwardly from the upper part 21 of the lid 10, said flange being insertable into the lid attachment and having an external peripheral enlarged rim 26 by means of which it can be brought into sealing abutment under pressure against the inner side of the lower part 27 of the inner flange 16 of the lid attachment 11.

As can be seen most clearly in FIG. 4, the inner flange 16 of the lid attachment 11 is provided with an inner peripheral surface having a generally conical section 30 located between an upper section 28 having a larger diameter and a lower section 29 having a smaller diameter. The tubular inner flange 25 of the lid 10 is arranged, when inserted into the lid attachment 11, to be brought into abutment with the flange 16 close to the transition between the conical section 30 and the lower section 29 of this surface. The outer peripheral surface of the flange 16 is also shaped with a conical section 31 and can thus be brought into abutment under pressure with the neck 12 of the container 13 along a portion of this section 31 under the influence of flange 25 of the lid.

To enable the closure to be used as an original closure the lid 10 is provided at the lower edge of the wall 22 with a sealing ring 33 joined to this wall by breakable bridges 32. This ring is provided internally with a number of notches 34 provided with stop surfaces 35 at one end which, when the lid 10 is unscrewed from the lid attachment, can catch on hook-shaped protrusions 36 on the outer flange 15 of the lid attachment. The sealing ring 33 will thus be torn from the lid 10 when this is unscrewed from the lid attachment 11.

When the closure is applied on the container 13 it is first assembled by screwing the lid 10 onto the lid attachment 11. The embodiment with protrusions 36 shown in FIG. 4 ensures that the sealing ring 33 can be inserted over the protrusions without the risk of being torn from the lid. The closure assembled in this way is then pressed onto the neck 12 of the container, whereupon the lid attachment will snap into engagement therewith.

We claim:

1. A screw top closure comprising a screw lid (10) with internal threading and a separate lid attachment (11) with external threading, said attachment being designed for application on the neck (12) of a container (13) to carry the removable lid, the lid attachment (11) being in the form of an annular element with an upper part (14) serving as a support for the lid (10) and outer and inner concentric tubular flanges (15, 16) the outer concentric flange (15) protruding downwardly for surrounding the neck (12) of the container (13) and the inner concentric flange protruding downwardly for entering into the neck (12) of the container (13) so that the flanges define between them in downward direction an open pocket (17) for receipt of the neck (12) of the container (13), the lid (10) being provided with an inner tubular flange (25) protruding downwardly from an upper portion (21) thereof, and being insertable into the lid attachment (11), the inner flange (16) of the lid attachment (11) and the inner tubular flange (25) of the lid (10) being so constructed and arranged that the inner tubular flange (25) may be inserted into sealing abutment against a lower portion of the inner tubular flange (16) of the lid attachment (11), the lower portion of the inner flange (16) having a reduced inner diameter and a lower portion of the inner tubular flange (25) of the lid (10) having an external peripheral enlarged rim (26) such that the inner flange (16) of the lid attachment (11) and the inner flange (25) of the lid (10) will remain in sealing abutment with each other during partial unscrewing of the lid (10) from the neck (12) of the container (13).

2. A screw top closure as claimed in claim 1, wherein the inner flange (16) of the lid attachment (11) is provided with an inner peripheral surface having a generally conical section (30) located between an upper section (28) having larger diameter and a lower section (29) having smaller diameter, the inner flange (25) of the lid (10) being arranged to be brought into abutment with the inner flange (16) of the lid attachment (11) in a region of its inner surface located close to the transition between the generally conical section (30) and the lower section (29).

3. A screw top closure as claimed in claim 2, wherein the inner flange (16) of the lid attachment (11) is provided with an outer peripheral surface having a conical section (31) for abuting under pressure with the inner side of the neck (12) of the container (13) without being influenced by the inner flange (25) of the lid (10).

4. A screw top closure as claimed in claim 1, being provided with sealing means (33) for sealing a container (13) closed by means of the closure, wherein said sealing means comprise a sealing ring (33) joined by breakable bridges (32) to the lower part of a wall (22) of the lid (10), said ring being designed to be separated from the lid (10) when the lid (10) is unscrewed from the lid attachment (11), due to the action of protrusions (36) in the outer tubular flange (15) of the lid attachment (11) protruding into notches (34) in the sealing ring.

5. A screw top closure as claimed in claim 1, wherein the outer tubular flange (15) of said lid attachment (11) on its lower part at the inside thereof is provided with a protrusion (18) for cooperating with a radial protrusion (19) on the outside of said neck (12) such that the protrusion (18) of the lid attachment (11) may snap in under the radial protrusion (19) of the neck (12) and wherein the inner flange (16) of said lid attachment (11) at its upper part forms a downwardly conically tapered sealing surface (31) for cooperating with an upper inner rim region of said neck (12) during the cooperation of said protrusions (18, 19).

* * * * *